United States Patent [19]

Beasley

[11] Patent Number: 5,050,488

[45] Date of Patent: Sep. 24, 1991

[54] METHOD OF LOCKING A PIVOTABLE ASSEMBLY FOR SHIPPING

[75] Inventor: John A. Beasley, Clarksville, Tenn.

[73] Assignee: American Standard Inc., New York, N.Y.

[21] Appl. No.: 632,253

[22] Filed: Dec. 21, 1990

[51] Int. Cl.[5] ..... F24F 7/007; F24F 13/00

[52] U.S. Cl. ..... 98/34.6; 98/33.1; 98/34.5; 98/38.6; 62/326

[58] Field of Search ..... 98/34.6, 33.1, 34.5, 98/38.4, 38.5, 38.6; 62/326, 427; 237/46, 53; 49/137, 324

[56] References Cited

U.S. PATENT DOCUMENTS

| | | | |
|---|---|---|---|
| 885,570 | 4/1908 | Bergquist | 49/324 |
| 1,563,655 | 12/1925 | Prior | 49/324 |
| 2,325,897 | 8/1943 | Waltman | 49/324 |
| 3,650,069 | 3/1972 | Alley | 49/7 |
| 4,580,365 | 4/1986 | Sieg | 49/137 |
| 4,759,196 | 7/1988 | Davis | 62/326 |
| 4,766,807 | 8/1988 | Davis | 98/121 |
| 4,843,839 | 7/1989 | Davis | 62/326 |

*Primary Examiner*—Albert J. Makay
*Assistant Examiner*—William C. Doerrler
*Attorney, Agent, or Firm*—William J. Beres; William O'Driscoll

[57] ABSTRACT

A damper interlock mechanism comprising a housing including first and second apertures, a damper assembly pivotably mounted in the first aperture and a swing out unit pivotably mounted in the second aperture for pivotal movement between a first shipping position and a second operational position. The mechanism also includes an actuator for actuating the damper, and a damper control rod having a first end operationally connected to the actuator, a second end operationally connected to the damper assembly, and an intermediate portion. The intermediate portion includes means for interlocking the damper control rod with the swing out unit when the swing out unit is in the shipping position.

18 Claims, 3 Drawing Sheets

METHOD OF LOCKING A PIVOTABLE ASSEMBLY FOR SHIPPING

BACKGROUND OF THE INVENTION

The present invention is directed to the field of air handling enclosures, and more specifically, to the protection of return air dampers in air conditioning units and other air handling enclosures during shipping and handling.

In U.S. Pat. No. 4,843,839 to Davis assigned to the assignee of the present application, the return air damper assembly is pivotably attached to a swing out economizer at the edge of the damper. Since the pivot axis is attached to the swing out economizer, the entire return air damper assembly is moved to the protected interior position shown in FIG. 2 of this patent whenever the economizer is in the closed position.

However, when a centrally pivoted return air damper assembly such as is shown in FIG. 1 of U.S. Pat. No. 4,766,807, also to Davis and also assigned to the assignee of the present application, is desired to be used, damage to the damper assembly has been found to occur when the air handling enclosure is shipped to a job site. The damage occurs because the damper assembly is no longer pivotably mounted on the economizer itself, instead being moveably attached at each axial end to the housing of the air handling enclosure. Consequently, the damper assembly is no longer moved to a protected position when the economizer is placed in the closed position. The result is that the damper assembly in the open position has an edge which extends below the base of the unit and sustains damage during shipping, handling, and trucking.

SUMMARY OF THE INVENTION

It is an object, feature and advantage of the present invention to solve the problems of prior air handling enclosures.

It is an object, feature and advantage of the present invention to provide a mechanism which ensures that the damper assembly is maintained in the closed position during shipping and handling.

It is an object, feature and advantage of the present invention to provide a mechanism which is automatically disengaged when the air handling enclosure is installed.

The present invention provides a damper interlock mechanism comprising a housing including first and second apertures, a damper assembly pivotably mounted in the first aperture and a swing out unit pivotably mounted in the second aperture for pivotal movement between a first shipping position and a second operational position. The mechanism also includes an actuator for actuating the damper and a damper control rod having a first end operationally connected to the actuator means, a second end operationally connected to the damper assembly, and an intermediate portion. The intermediate portion includes means for interlocking the damper control rod with the swing out unit when the swing out unit is in the shipping position.

The present invention provides an air handling enclosure comprising an assembly pivotable between a shipping position and an operational position; and a damper assembly including a damper, an actuator, and a link operationally connecting the damper and the actuator. The link includes means for interlocking the damper assembly with the pivotable assembly when the pivotable assembly is in the shipping position.

The present invention provides an air conditioning enclosure comprising a housing including a first aperture and a second aperture; a swing out economizer pivotably mounted in the second aperture for movement between a shipping position and an operational position; and a damper assembly pivotably mounted in the first aperture. The damper assembly includes an actuator, a damper and a control rod connected to the actuator and the damper. The control rod includes means for interlocking with the swing out economizer when the swing out economizer is in the shipping position.

The present invention provides an actuator rod comprising a rod including a first end having means for engaging a device to be actuated, a second end having means for engaging an actuator, and an intermediate portion joining the first end to the second end. The intermediate portion also includes means for interlocking the rod with an external device.

The present invention provides a method of protecting a damper in an air handler unit from shipping damage comprising the steps of pivoting a swing out economizer to a shipping position, thereby engaging a damper actuator rod with the swing out economizer; shipping the air handling unit; and pivoting the swing out economizer to an operational position thereby releasing the damper actuator rod.

DETAILED DESCRIPTION OF THE INVENTION

Figure 1:
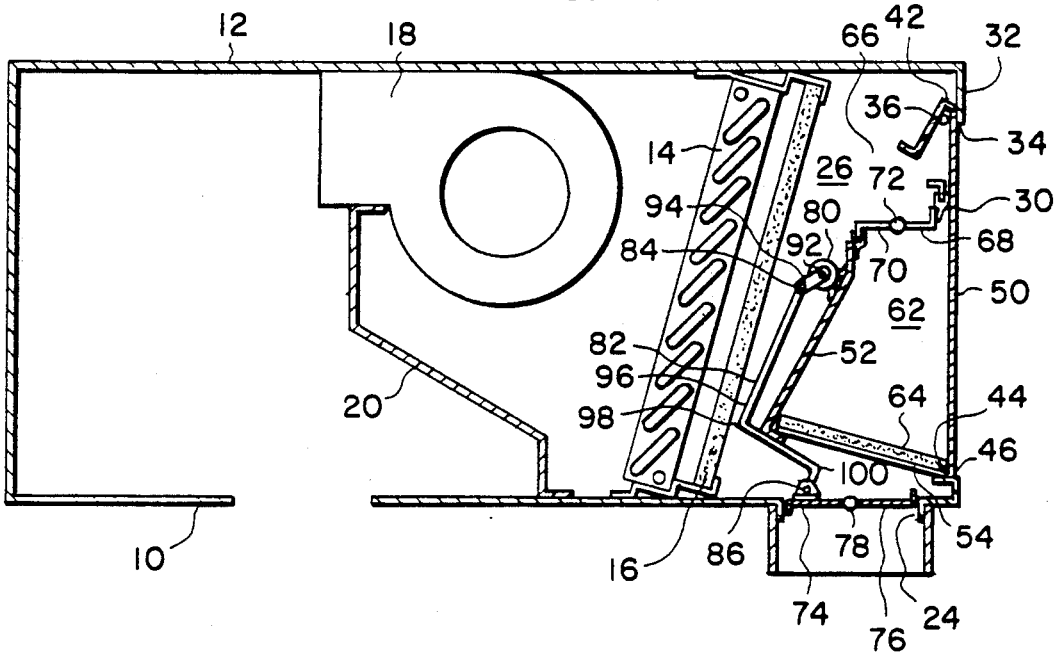
FIG. 1 shows an air handling enclosure including a swing out economizer, a centrally pivoted damper assembly and the interlock mechanism of the present invention in the closed position.

An air handler unit for an air conditioning system is generally denoted by reference numeral 10 as shown in FIG. 1. Air handler unit 10 is of the type commonly found in central air conditioning systems having a duct work system providing conditioned air to a number of rooms or conditioned spaces, and a duct work system for returning air from the rooms or conditioned spaces to the air handler unit to be conditioned therein. Typically, the duct work system is installed above a false ceiling over the rooms or conditioned spaces and below the roof or ceiling, as the case may be, above the false ceiling. The air handler unit 10 is then installed in connection with the duct work system immediately above the duct work system or upon the roof of the structure. The details of the cooperation between the duct work system and the air handler unit 10 are not shown, as it is believed that the state of the art of the duct work system is well understood and that further description thereof is not necessary to understand the form and function of the subject invention.

Figure 2:
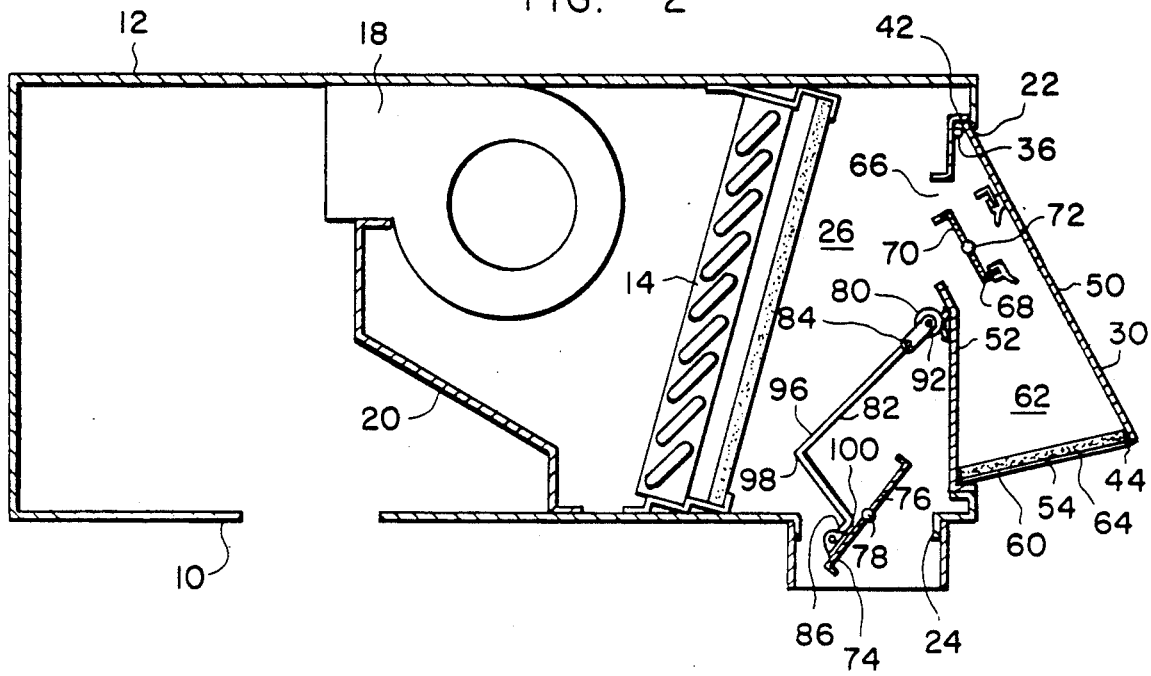
FIG. 2 shows an air handling enclosure including a swing out economizer and a centrally pivoted damper assembly in the operational position.

The air handler unit 10 as shown in FIGS. 1 and 2, consists generally of an enclosure 12 with a heat exchanger coil 14 disposed therein A filter 16 and a centrifugal fan 18 are located on opposite side of the heat exchanger coil 14. A partition 20 joins the centrifugal fan 18 to the enclosure 12 to create an air directing channel, whereby supply air is drawn through the filter 16 and the heat exchange coil 14 by the fan 18 and then directed from the enclosure 12 into the duct work system and to the conditioned spaces. The supply air is drawn through an economizer assembly aperture 22 or a return air intake 24 prior to being drawn through the filter 16 by the fan 18.

A swing out economizer 30 is shown mounted in a wall 32 of the enclosure 12. The economizer assembly 30 permits free-cooling, whereby cooling of the conditioned spaces in the structure is accomplished by the intake of cool ambient air through the economizer assembly 30. When this cool ambient air is available, no mechanical cooling of the supply air need be performed. It is also possible to obtain make-up air through the economizer assembly 30. This replaces, or makes-up for, the loss of air incurred by leakage in the structure. Exhausting air from the structure for purging the conditional spaces is an additional function of the economizer assembly 30. This is accomplished, for example, by reversing the rotation of the fan 18 or by providing air directing dampers to direct return air out through the economizer assembly 30. These uses of an economizer assembly are illustrative and not to be taken as limiting.

Figure 3:
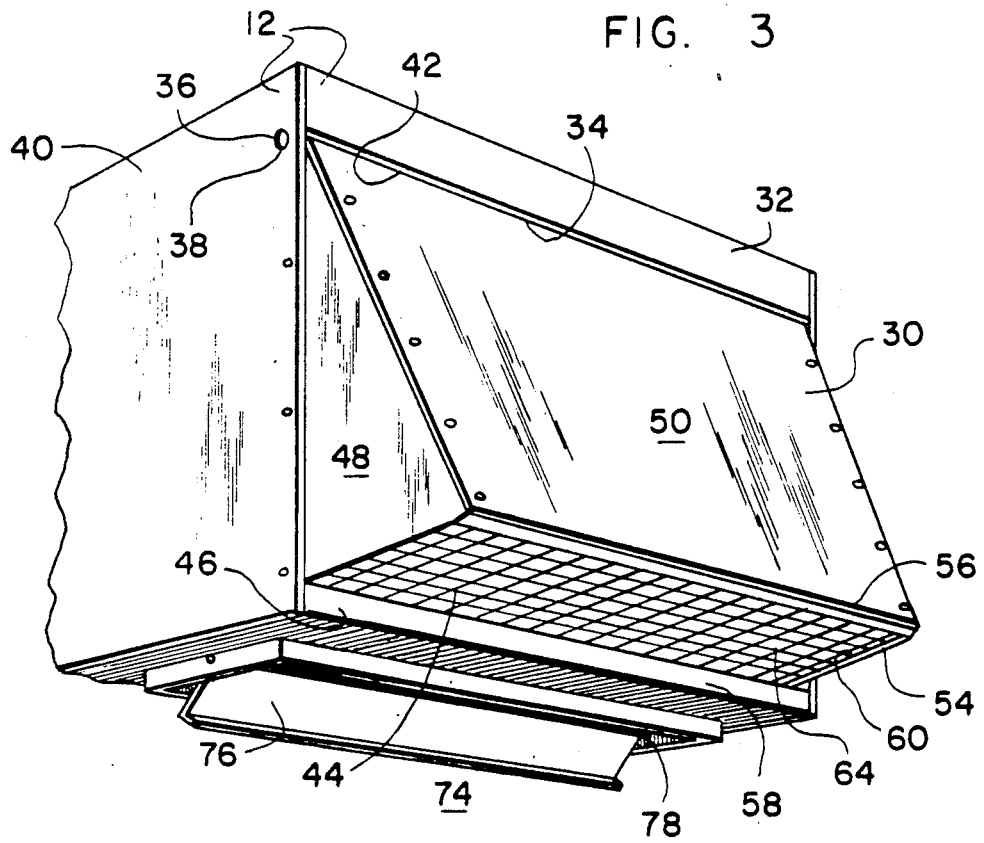
FIG. 3 shows a perspective view of the swing out economizer of FIGS. 1 and 2 including the return air damper in the open position.
Figure 4:
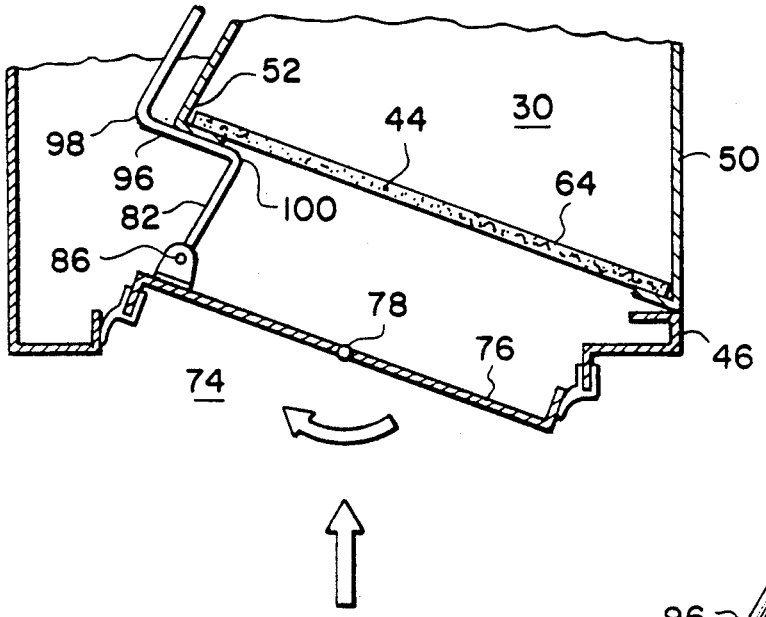
FIG. 4 shows the return air damper assembly of FIG. 1.
Figure 6:
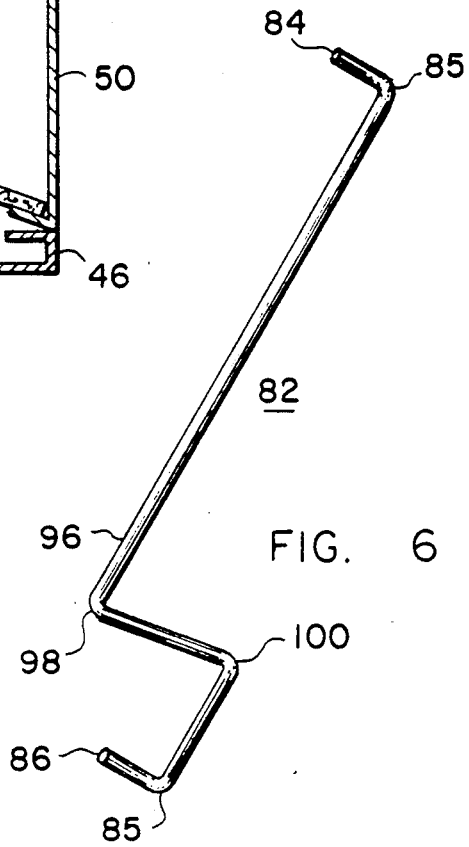
FIG. 6 shows the damper control rod incorporating the interlock mechanism of FIG. 1.
Figure 5:
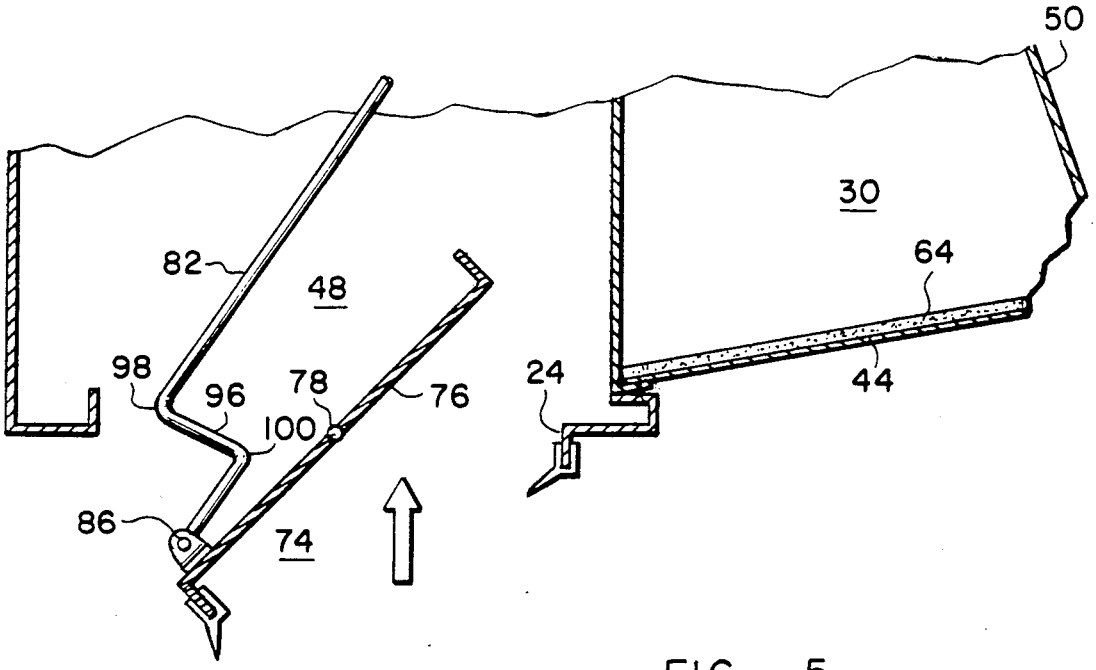
FIG. 5 shows the return air damper assembly of FIG. 2.

Referring now to FIGS. 1 through 3 generally, the economizer assembly aperture 22 is shown defined in a wall 32 of enclosure 12 for accepting the economizer assembly 30. Preferably, the economizer assembly aperture 22 is defined in the wall 32 by a plurality of edges, for example, a rectangular aperture defined by four linear edges.

A means for pivotally mounting the economizer assembly 30 is located adjacent one edge, preferably the top edge 34, of the assembly aperture 22. This pivotal mounting means is preferably one or more pivot pins 36, which may be a bolt or a screw, extending through an aperture 38 in the wall 40 and into the economizer assembly 30 in a pivotally securing manner. The economizer assembly 30 may be pivoted on a pivot pin 36 to a first or closed position, with at least a portion of the economizer assembly 30 accepted into the interior 26 of the air handler unit 10, and to a second or open position to permit economizer operation of the air handler unit 10.

The economizer assembly 30 has a proximate end 42 adjacent the top edge 34 for pivotal mounting to the enclosure 12, a distal end 44 directly removed therefrom for cooperating with a bottom edge 46 of the wall 32, and two opposite sides 48 extending between the proximate end 42 and the distal ends 44 of the economizer assembly 30. More particularly, the economizer assembly 30 includes a generally planar exterior wall comprising a hood member 50 extending from the proximate end 42 to the distal end 44 of the economizer assembly 30 and further extending between the sides 48 of the economizer assembly 30. When the economizer assembly 30 is in the first position, the hood 50 is generally coplanar with the wall 32 and extends across the assembly aperture 22 in a covering manner.

The opposite sides 48 of the economizer assembly 30 are in the preferred embodiment more particularly described as side closure members 48 affixed to the hood 50 and extending into the assembly aperture 22 in a manner generally perpendicular to the hood 50 so as to project into the interior 26 of the enclosure 12 in the first position. Each side closure member 48 is generally triangular in shape, with the base of the triangle at the distal end 44 of the economizer assembly 30 and then narrowing toward the proximate end 42.

An assembly interior wall 52 extends between the side closure members 48 to complete an enclosed economizer assembly 30. The assembly interior wall 52 and the hood 50 are thus relatively narrowly spaced at the proximate end 42 and widely spaced at the distal end 44 of the economizer assembly 30 by the triangularly shaped side closure members 48.

Each of the side closure members 48, the hood 50 and the assembly interior wall 52 have a distal end 54, 56, 58 respectively corresponding generally to the distal end 44, and a proximate end corresponding generally to the proximate end 44 of the economizer assembly 30. The respective distal ends 54, 56, 58 of the side closure members 48, the hood 50, and the assembly interior wall 52 together comprise a rectangular economizer inlet 60. The assembly interior wall 52 the hood 50 and the side closure members 48 cooperate to define a passage 62 for accepting a flow of air through the economizer assembly 30 from the economizer inlet 60.

An economizer filter 64 extends across the economizer inlet 60 for filtering air admitted through the economizer inlet 60. The economizer filter 64 may be retained in the economizer inlet 60 by means of a lip extending about the economizer inlet 60, for example, or by bolts or screws.

A damper aperture 66 is provided in assembly interior wall 52, for accepting a primary damper blade assembly 68 thereacross. The primary damper blade assembly 68 consists of a primary damper blade 70 pivotally mounted on a conventional pivot hinge 72 and positioned to selectively cover the damper aperture 66. A damper actuator (not shown) is connected to the primary damper blade 70 for driving the primary damper blade 70 between a closed position which covers the damper aperture 66, and to an open position which opens the damper aperture 66, and permits a flow of air through the damper aperture 66 from the economizer assembly 30 at a predetermined rate according to the position of the primary damper blade 70.

A secondary damper blade assembly 74 consisting of a secondary damper blade 76 pivotally mounted on an axis 78 is positioned to selectively cover the return air intake 24. A secondary damper actuator 80 is connected to the secondary damper blade 76 by means of a damper actuator rod 82 for driving the secondary blade 76 between a closed position, for preventing air flow through the return air intake 24, and an open position for permitting an air flow through the return air intake 24. The damper actuator rod 82 is pivotably connected at a first end 84 to the secondary damper actuator 80, and at a second end 86 to the secondary damper blade assembly 74. For simplicity of description, the damper actuator rod 82 is described as a single rod connected to a central portion of the secondary damper blade assembly 74. It should be recognized that the preferred embodiment is shown and subsequently described in connection with FIG. 7 as having a pair of damper actuator rods where a single actuator contacts both the primary and secondary dampers.

The damper actuator rod 82 is a cylindrical rod 82, formed of zinc plated steel, having fastening means at the first end 84 through which a fastener such as a cotter pin, bolt, or screw may be inserted to pivotably attach the first end 84 on the secondary damper actuator 80. In the preferred embodiment, each end 84, 86 of the damper actuator rod 82 includes a pivot bend 85 which projects perpendicularly from the plane of the damper actuator rod 82. The pivot bend 85 at the first end 84 is inserted through the secondary damper actuator 80 then movably retained utilizing the fastening means.

The damper actuator rod 82 also includes the second end 86 which includes means for engaging a device, such as the return air damper assembly 74, to be actuated. The second end 86 can be attached at a central pivot axis 78 as shown in FIGS. 1 through 3, or at a free end of the damper. Similar fastening means for moveably or pivotably linking the second end 86 to the secondary blade 76 are contemplated as described above in connection with the first end 84. In the preferred embodiment, the pivot bend 85 of the second end 86 is movably inserted and affixed to the return air damper assembly 74.

The damper actuator rod 82 includes an intermediate portion 96 joining the second and the first ends 86, 84. The intermediate portion 96 includes means for interlocking the damper rod 82 with the economizer 30 when the economizer 30 is in the shipping position shown in FIG. 1. In the preferred embodiment such interlocking means includes at least two interlock bends 98, 100 in the damper rod 82 adapted to engage the interior wall 52 and the distal end 44 of the economizer 30 when the economizer 30 is in the shipping position. When interlocked, the damper rod 82 cannot be moved, and the damper assembly 74 is held in the closed position. In the installed position the damper rod 82 is freely moveable and the damper assembly 74 is correspondingly adjustable.

Figure 7:
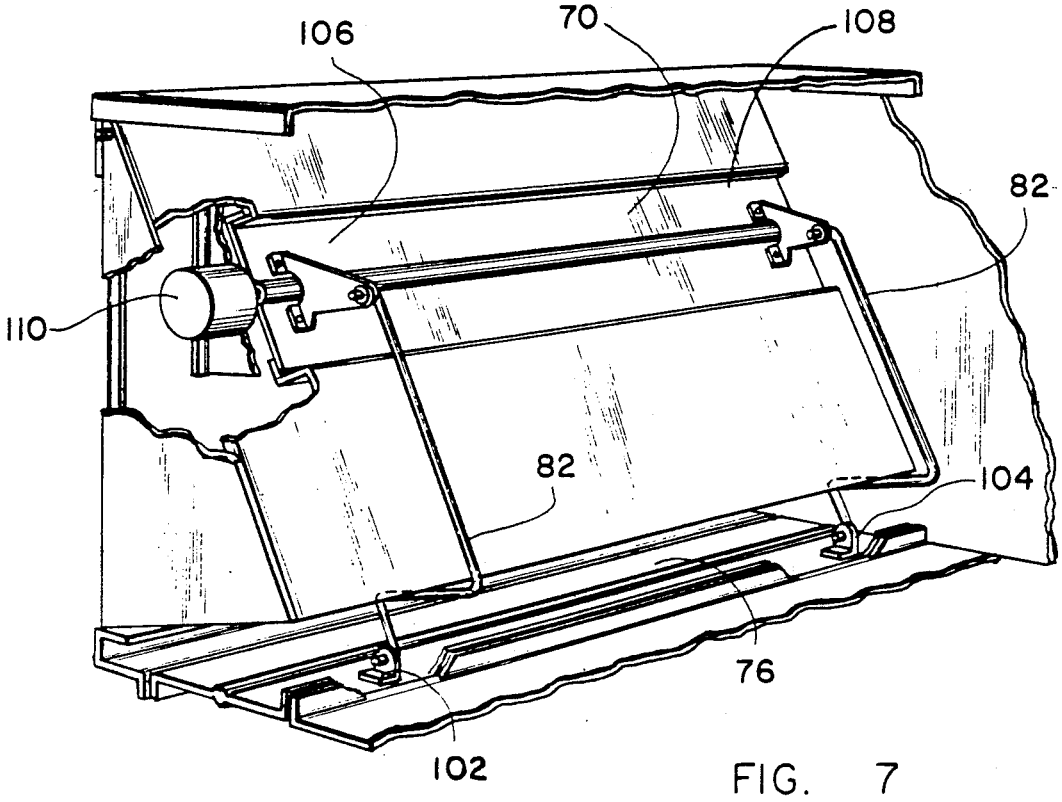
FIG. 7 shows the preferred embodiment of the present invention including a pair of damper rods.

FIG. 7 shows the preferred embodiment of the invention where first and second damper actuator rods 82 are pivotably attached at each end 102, 104 of the secondary damper blade 76. Each of the first and second damper rods 82 are pivotably connected to respective ends 106, 108 of the primary damper blade 70 so that a single actuator 110 will operate to drive the primary damper blade 70 open and the secondary damper blade 76 closed. Likewise, the single actuator 110 will operate to drive the primary damper blade 70 closed, and the secondary damper blade 76 open.

In the alternative embodiment shown in FIGS. 1 and 2, the first end 84 of a single damper actuator rod 82 is attached to the secondary damper actuator 80 at a moveable pivot point 88, and the secondary damper actuator 80 is pivoted by an actuator 94 about a fixed pivot point 92 conventionally attached to the assembly interior walls 52. Alternatively, the secondary damper actuator 80 may be mounted on a bracket supported by the enclosure 12. In these alternative embodiments the secondary damper blade assembly 74 is actuated independently of the primary damper blade assembly 68.

Preferably, the secondary damper blade 76 is driven closed as the primary damper blade 70 is driven open. This configuration will then cause the fan 18 to draw supply air primarily or entirely from the economizer assembly 30 into the enclosure 12. Likewise, for drawing supply air primarily or entirely from the return air intake 24 the secondary damper blade 76 is driven open and the primary damper blade 70 is driven closed. The primary damper blade 70 and the secondary damper blade 76 are cooperatively driven to open and closed positions and to positions between open and closed. By virtue of this cooperation, ambient air is admitted through the economizer assembly 30 in a proportion to the return air admitted through the return air inlet 24 which is consistent with the most energy efficient operation of the air handler unit 10. Of course, as alluded to above, the primary and secondary damper blade assemblies 68, 74 can operate independently of each other if each assembly has its own actuator.

The present invention takes effect when the air handling unit is being prepared for shipping to an installation site. The first shipping position of the economizer assembly 30 is clearly shown in FIG. 1. In the first position, at least a portion of the economizer assembly 30 is closely received into the interior 26 of the enclosure 12 of the air handling unit 10, leaving only the hood 50 exposed, being in this position generally coplanar with the wall 32. As the economizer assembly 30 is pivoted into the interior 26, the interior wall 52 of the economizer 30 and the distal end 44 of the economizer 30 engage the interlock bends 98,100 in the intermediate portion 96 of the damper rod 82, securing the damper rod 82 and the secondary damper assembly 74 in the closed shipping position. The economizer assembly 30 is closely received into the enclosure 12 in that there is a substantially small clearance, for example, one inch or less, between the side closure members 48 and the edges defining the assembly aperture 22 in the enclosure 12. In this position air handling unit 10 may be readily shipped as the enclosure 12 presents a rectangular box with all economizer and damper components protected in the interior of the enclosure 12.

Upon completion of shipping and installation, the economizer assembly 30 is then pivoted outward to a second, operational position, as shown in FIG. 2, and secured in the second position by a number of bolts or screws. In the second position, the planar exterior hood 50 diverges angularly from the plane defined by the wall 32. The proximate end of the hood 50, the distal end 58 of the assembly interior wall 52, and the side closure members 48 sealingly engage the edges defining the assembly aperture 22 in an air flow preventing manner. This prevents an intake of ambient air into the interior 26 of the air handler other than through the economizer inlet 42 and the passage 62 defined in the economizer assembly 30, so that undesirable uncontrolled mixing of return air and ambient air cannot occur.

As the economizer assembly 30 is pivoted outwardly, the interior wall 52 and the distal end 44 of the economizer 30 disengage from the interlock bends 98, 100 in the intermediate portion 96 of the damper rod 82. The damper rod 82 is no longer secured in place by the economizer 30. This allows the secondary damper actuator 80 to freely control the position of the secondary damper blade 76.

Although the preferred embodiment is described above, it is apparent that many alterations and modifications may be made without departing from the subject invention. In particular, the shape of the damper actuator rod and the angles of the interlock bends will vary with the shape of the swing out enclosure. Additionally, the location and implementation of both the actuator and the return air damper may be varied, for instance, to an edge pivoted return air damper. Also, the swingout enclosure may be other than an economizer. It is intended that all such alterations and modifications be considered within the spirit and scope of the invention as defined in the following claims.

What is claimed and desired to be secured by Letters Patent of the United States is:

1. A damper interlock mechanism comprising:

a housing including first and second apertures;

a damper assembly pivotably mounted in the first aperture;

a swing out unit pivotably mounted in the second aperture for pivotal movement between a first shipping position and a second operational position;

means for actuating the damper; and a first damper control rod having a first end operationally connected to the actuator means, a second end operationally connected to the damper assembly, and an intermediate portion including means for interlocking the damper control rod with the swing out unit when the swing out unit is in the shipping position.

2. The damper interlock mechanism of claim 1 including a second damper control rod having a first end operationally connected to the actuator means, a second end operationally connected to the damper assembly, and an intermediate portion including means for interlocking the damper control rod with the swing out unit when the swing out unit is in the shipping position.

3. The damper interlock mechanism of claim 1 wherein the damper actuating means is mounted on the swing out unit.

4. An air handling enclosure comprising:

an assembly pivotable between a shipping position and an operational position; and a damper assembly including a damper, an actuator, and a first link operationally connecting the damper and the actuator, the first link including means for interlocking the damper assembly with the pivotable assembly when the pivotable assembly is in the shipping position.

5. The enclosure of claim 4 wherein the first link includes a cylindrical rod and the interlock mechanism includes at least two opposing bends in the cylindrical rod.

6. The enclosure of claim 5 wherein the bends separate the rod into three portions, two of which substantially contact the pivotable assembly in the shipping position.

7. The enclosure of claim 6 wherein the damper is centrally pivoted.

8. The enclosure of claim 5 including clips to maintain the rod in a fixed position.

9. The enclosure of claim 5 wherein the actuator is mounted on the pivotable assembly.

10. The enclosure of claim 4 including a second link operationally connecting the damper and the actuator the first link including means for interlocking the damper assembly with the pivotable assembly when the pivotable assembly is in the shipping position.

11. The enclosure of claim 4 wherein the actuator is mounted on the pivotable assembly.

12. The enclosure of claim 4 wherein the first link is separated into three portions, two of which substantially contact the pivotable assembly in the shipping position.

13. An air conditioning enclosure comprising:

a housing including a first aperture and a second aperture;

a swing out economizer pivotably mounted in the second aperture for movement between a shipping position and an operational position;

a damper assembly pivotably mounted in the first aperture and including an actuator, a damper and a first control rod connected to the actuator and the damper, wherein the first control rod includes means for interlocking with the swing out economizer when the swing out economizer is in the shipping position.

14. The enclosure of claim 13 including a second control rod connected to the actuator and the damper wherein the first control rod includes means for interlocking with the swing out economizer when the swing out economizer is in the shipping position.

15. The enclosure of claim 13 wherein the damper is centrally pivoted.

16. The enclosure of claim 13 wherein the actuator is mounted on the swingout economizer.

17. A method of protecting a damper and a swing out economizer hood in an air handler unit from shipping damage comprising the steps of:

engaging a first damper actuator rod and the associated damper with the swing out economizer hood by pivoting the swing out economizer hood and consequently the damper to a shipping position;

shipping the air handling unit; and moving the first damper actuator rod and the damper by pivoting the swing out economizer hood to an operational position.

18. The method of claim 17 including the further steps of engaging a second damper actuator rod, and releasing a second damper actuator rod.

* * * * *